US010600369B2

(12) United States Patent
Kim et al.

(10) Patent No.: US 10,600,369 B2
(45) Date of Patent: Mar. 24, 2020

(54) DATA DRIVER AND ORGANIC LIGHT EMITTING DISPLAY DEVICE

(71) Applicant: LG DISPLAY CO., LTD., Seoul (KR)

(72) Inventors: Taehun Kim, Paju-si (KR); Kitae Kwon, Paju-si (KR); Kyujin Kim, Goyang-si (KR); Jiah Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 69 days.

(21) Appl. No.: 15/835,171

(22) Filed: Dec. 7, 2017

(65) Prior Publication Data

US 2019/0005888 A1 Jan. 3, 2019

(30) Foreign Application Priority Data

Jun. 30, 2017 (KR) ..... 10-2017-0083711

(51) Int. Cl.
*G09G 3/3291* (2016.01)
*G09G 3/3233* (2016.01)
*G09G 3/3258* (2016.01)

(52) U.S. Cl.
CPC ..... *G09G 3/3291* (2013.01); *G09G 3/3233* (2013.01); *G09G 3/3258* (2013.01); *G09G 2300/0814* (2013.01); *G09G 2300/0819* (2013.01); *G09G 2310/027* (2013.01); *G09G 2310/0251* (2013.01); *G09G 2320/0233* (2013.01); *G09G 2320/0295* (2013.01); *G09G 2320/045* (2013.01)

(58) Field of Classification Search
CPC .. G09G 3/3291; G09G 3/3233; G09G 3/3258; G09G 2320/0295; G09G 2310/0251; G09G 2300/0819; G09G 2300/0814; G09G 2310/027; G09G 2320/045; G09G 2320/0233
See application file for complete search history.

(56) References Cited

U.S. PATENT DOCUMENTS 7,339,511 B2 * 3/2008 Son ..... G09G 3/20 341/144
2007/0030192 A1 * 2/2007 Son ..... G09G 3/20 341/156

(Continued)

FOREIGN PATENT DOCUMENTS

CN 105989803 A 10/2016
JP 2009-288767 A 12/2009

(Continued)

*Primary Examiner* — Nitin Patel
*Assistant Examiner* — Amy Onyekaba
(74) *Attorney, Agent, or Firm* — Seed Intellectual Property Law Group LLP

(57) ABSTRACT

The disclosure relates to data driver and organic light emitting display device. The data driver includes: an input unit configured to receive an input data; a compensation data generator configured to generate a compensation data by applying a compensation value to the input data; a converter unit configured to convert the input data into an image data voltage and to convert the compensation data into a compensation data voltage; and an output unit configured to separately output the image data voltage and the compensation data voltage to a data line of the organic light emitting display.

20 Claims, 7 Drawing Sheets

(56) References Cited

U.S. PATENT DOCUMENTS

2007/0120780 A1* 5/2007 Park ..... G09G 3/3291 345/76
2007/0263121 A1 11/2007 Take et al.
2008/0238953 A1* 10/2008 Ogura ..... G09G 3/3275 345/697
2008/0252568 A1* 10/2008 Kwon ..... G09G 3/3233 345/76
2008/0252569 A1* 10/2008 Kwon ..... G09G 3/3233 345/76
2009/0027423 A1* 1/2009 Kwon ..... G09G 3/3233 345/690
2009/0051628 A1* 2/2009 Kwon ..... G09G 3/3233 345/77
2009/0058772 A1 3/2009 Lee
2009/0184901 A1* 7/2009 Kwon ..... G09G 3/3233 345/77
2009/0184903 A1* 7/2009 Kwon ..... G09G 3/3225 345/80
2010/0182349 A1* 7/2010 Miyazaki ..... G09G 3/3688 345/690
2010/0253608 A1* 10/2010 Kim ..... G09G 3/3233 345/76
2010/0321367 A1* 12/2010 Shona ..... G09G 3/3233 345/211
2011/0007067 A1* 1/2011 Ryu ..... G09G 3/3233 345/214
2011/0018858 A1* 1/2011 Ryu ..... G09G 3/3233 345/213
2011/0032281 A1* 2/2011 Ietomi ..... G09G 3/3233 345/690
2011/0063283 A1* 3/2011 Ryu ..... G09G 3/3283 345/214
2011/0157134 A1* 6/2011 Ogura ..... G09G 3/20 345/211
2011/0205250 A1* 8/2011 Yoo ..... G09G 3/3233 345/690
2011/0210958 A1* 9/2011 Yoo ..... G09G 3/325 345/214
2011/0221727 A1 9/2011 Kim et al.
2013/0083087 A1 4/2013 Byun et al.
2013/0321497 A1 12/2013 Kang
2014/0118410 A1* 5/2014 Oh ..... G09G 3/3208 345/690
2014/0347253 A1* 11/2014 Lee ..... H05B 33/0896 345/76
2015/0002502 A1* 1/2015 Kim ..... G09G 3/3233 345/212
2016/0042695 A1* 2/2016 Park ..... G09G 3/3614 345/690
2016/0098959 A1* 4/2016 Moon ..... G09G 3/2092 345/205
2016/0247451 A1* 8/2016 Kim ..... G09G 3/3258
2017/0092200 A1 3/2017 Park et al.
2018/0012543 A1* 1/2018 Lee ..... G09G 3/3233
2018/0013085 A1* 1/2018 Shin ..... G02F 1/133365

FOREIGN PATENT DOCUMENTS

JP 2013-33228 A 2/2013
JP 2013-210407 A 10/2013
JP 2014-123129 A 7/2014
TW 201430804 A 8/2014
TW 201434025 A 9/2014
TW 201445541 A 12/2014
TW 201523564 A 6/2015
TW I614738 B 2/2018
WO 2013/065596 A1 5/2013

* cited by examiner

DATA DRIVER AND ORGANIC LIGHT EMITTING DISPLAY DEVICE

This application claims the benefit of Korea Patent Application No. 10-2017-0083711 filed on Jun. 30, 2017, the entire contents of which is incorporated herein by reference for all purposes as if fully set forth herein.

BACKGROUND

Technical Field

The present disclosure relates to an active-matrix organic light emitting display device.

Description of the Related Art

An active matrix-type electroluminescent display device includes a self-emitting Organic Light Emitting Diode (OLED), and has advantages of a fast response time, a high light emitting efficiency, high luminance, and a wide viewing angle.

An OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display device includes a driving Thin Film Transistor (TFT) to control a driving current flowing in an OLED. It is desirable that the driving TFT is designed to have the same electrical characteristics, such as a threshold voltage and mobility, at each pixel. However, the electrical characteristics are not uniform at each pixel due to process condition and driving environment. For this reason, a driving current according to the same data voltage is different at each pixel, and this leads to differences in brightness between pixels. To solve this problem, there is an image quality compensation technology for sensing a characteristic parameter (threshold, mobility) of a driving TFT in each pixel and properly compensating for input data based on a sensing result in order to reduce non-uniformness of brightness.

An internal compensation method of the image quality compensation technology is to control a pixel structure and an operational timing in order to eliminate the influence of the electronic characteristics of a driving TFT while an organic light emitting diode emits light. Basically, the internal compensation method is to perform a sampling in which a gate voltage of a driving TFT is increased in a source follower method to be saturated at a predetermined level. To saturate the gate voltage of a driving TFT at the predetermined level, a sufficiently long time is required. However, as display panels tends to have a large screen and a high resolution, a time for sampling one pixel line is reduced, and thus, the sampling operation cannot be performed smoothly.

BRIEF SUMMARY

According to an embodiment, a data driver for an OLED is provided. The data driver includes: an input unit configured to receive an input data; a compensation data generator configured to generate a compensation data by applying a compensation value to the input data; a converter unit configured to convert the input data into an image data voltage and to convert the compensation data into a compensation data voltage; and an output unit configured to separately output the image data voltage and the compensation data voltage to a data line of the organic light emitting display.

According to another embodiment, an OLED device including the data driver according to the embodiment of the disclosure is provided.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. Detailed description of known arts will be omitted if it is determined that the arts can mislead the embodiments of the disclosure.

Hereinafter, embodiments of the present disclosure will be described with reference to the accompanying drawings.

Figure 1:
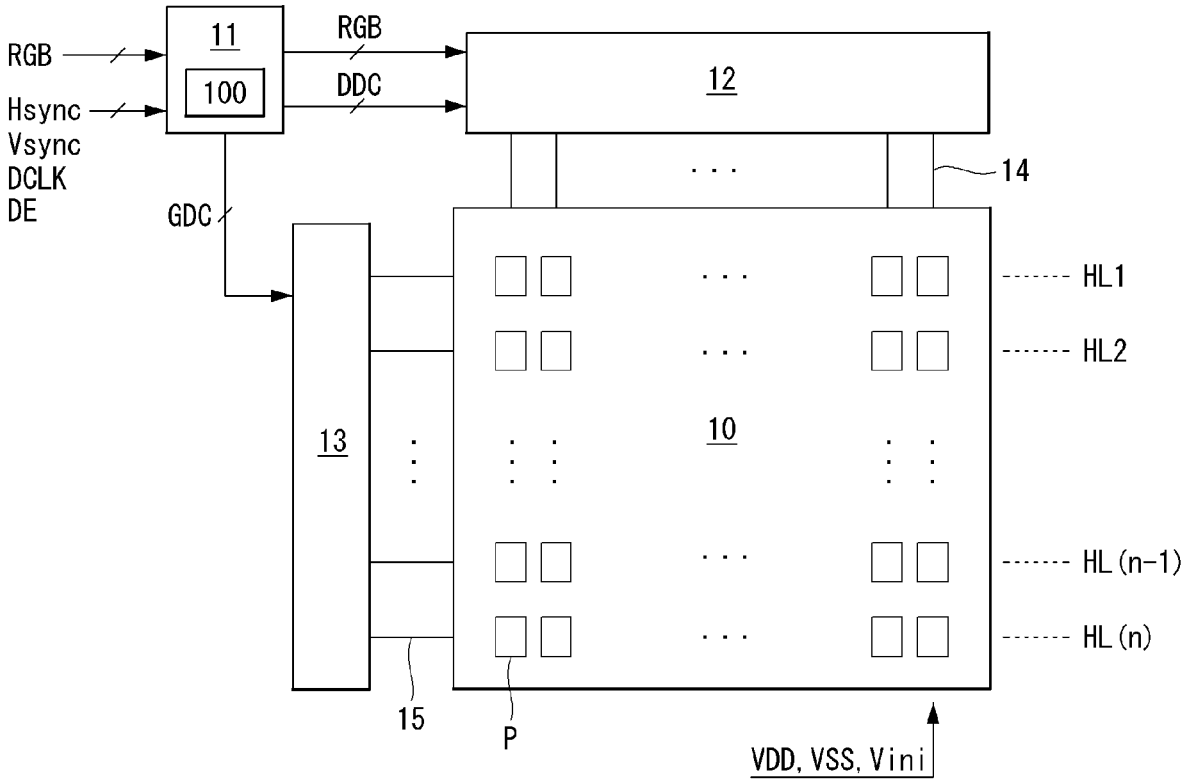
FIG. 1 is a diagram illustrating an organic light emitting display device according to an embodiment of the present disclosure.

FIG. 1 is a diagram illustrating an organic light emitting display device according to an embodiment of the present disclosure.

Referring to FIG. 1, an organic light emitting display device according to an embodiment of the present disclosure includes a display panel 10, a data driver 12, a gate driver 13, and a timing controller 11.

A plurality of data lines 14 and a plurality of gate lines 15 are intersecting one another on the display panel 10, and pixels P are arranged at the intersections in a matrix form. Each of the pixels P are supplied with a high-potential driving voltage VDD and a low-potential driving voltage VSS from a power generator that is not shown in the drawings.

Based on timing signals, such as a vertical synchronization signal Vsync, a horizontal synchronization signal Hsync, a dot clock signal DCLK, and a data enable signal DE, the timing controller 11 generates a data control signal DDC for controlling an operation timing of the data driver 12 and a gate control signal GDC for controlling an operation timing of the gate driver 13.

In addition, the timing controller 11 includes a compensation value setting unit 100. The compensation value setting unit 100 calculates a magnification of a compensation data voltage output from the data driver 12. The compensation data voltage is for over driving in a procedure of sensing a threshold voltage of a driving Thin Film Transistor (TFT) during a sensing period, and detailed description thereof will be provided later.

During a compensation period, the data driver 12 supplies a sensing data voltage to the pixels P, converts a sensing voltage received from the display panel 10 through the data lines 14 into a digital value, and supplies the digital value to the timing controller 11. During an image display period, the data driver 12 supplies an image display data voltage to the data lines 14.

The gate driver 13 may generate a gate signal based on a gate control signal GDC from the timing controller 11, and the gate signal may include scan signals and an emission signal. Depending on a pixel structure, the gate signal may different and timings of a gate signal applied during the compensation period and a gate signal applied during the image display period are different. The gate driver 13 may be formed directly on the display panel 10 through a Gate-driver In Panel (GIP) process.

Figure 2A:
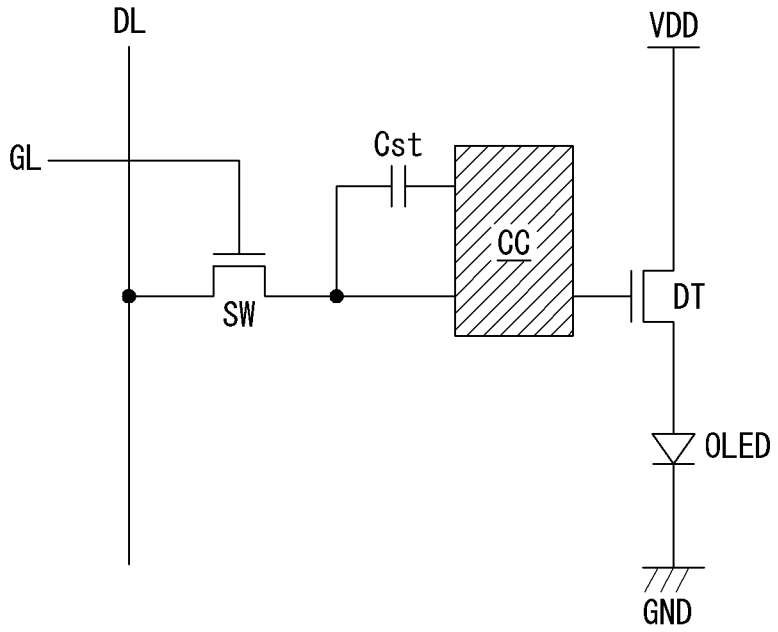
FIGS. 2A and 2B are diagrams illustrating examples of pixels.
Figure 2B:
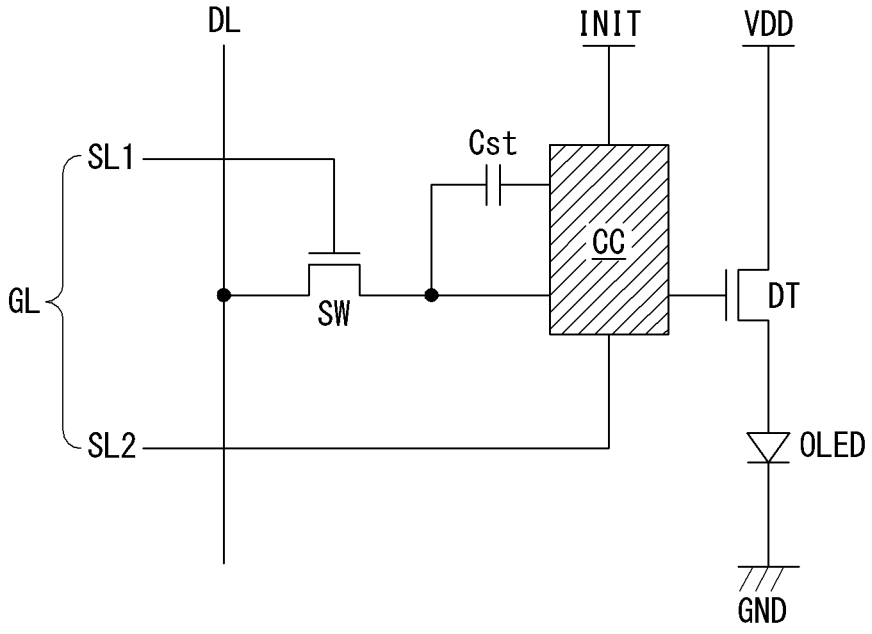

FIGS. 2A and 2B illustrate examples of pixel structures according to embodiments of the present disclosure.

Referring to FIG. 2A, one pixel include a switching transistor SW, a driving TFT DT, a compensation circuit CC, and an Organic Light Emitting Diode (OLED). The OLED operates to emit light due to a driving current formed by the driving TFT DT.

In response to a gate signal supplied through a first gate line GL, the switching transistor SW performs a switching operation so that a data signal supplied through a first data line DL is stored as a data voltage in a capacitor. Dependent upon the data voltage stored in the capacitor, the driving TFT DT operates to cause a driving current to flow between a high-potential power line VDD and a low-potential power line GND. The compensation circuit CC is a circuit for compensation of a threshold voltage of the driving TFT DT. In addition, the capacitor connected to the switching transistor SW or the driving TFT DT may be located inside of the compensation circuit CC.

The compensation circuit CC includes one or more thin film transistors (TFTs) and a capacitor. Configuration of the compensation circuit CC may vary depending on a compensation method, and detailed examples and description thereof are herein omitted.

In addition, as illustrated in FIG. 2B, when the compensation circuit CC is included, a pixel may further include a signal line and a power line in order to supply a specific signal or power while driving a compensation TFT. The additional signal line may be defined as a second gate line SL2 for driving a compensation TFT included in the pixel. In addition, the added power line may be defined as an initialization power line INIT for initializing a specific node of the pixel to a specific voltage. However, these are merely example pixel structures, and embodiments of the present disclosure are not limited thereto.

Figure 3:
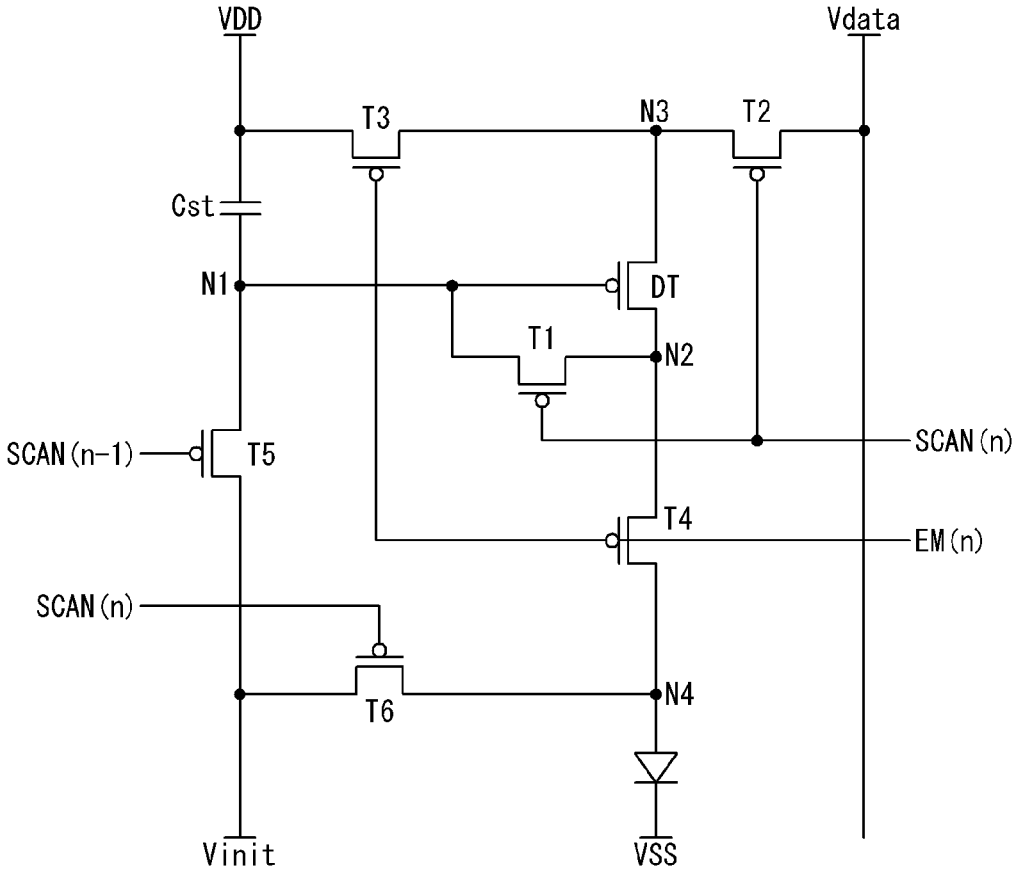
FIG. 3 is a circuit diagram of a pixel according to an embodiment of the present disclosure.

FIG. 3 is a diagram illustrating an example of a pixel that performs internal compensation. Herein, an internal compensation method implemented within the pixel shown in FIG. 3 will be described as below.

Referring to FIG. 3, a pixel according to an embodiment of the present disclosure includes a driving TFT, first to sixth transistors T1 to T6, and a storage capacitor Cst.

Based on its source-gate voltage Vsg, the driving TFT DT controls a driving current which is to be applied to the OLED. The driving TFT DT includes a gate electrode connected to a first node N1, a source electrode connected to a third node N3, and a drain electrode connected to a second node N2. In response to the n-th scan signal SCAN (n), the first transistor T1 connects the first node N1 and the second node N2. In response to the n-th scan signal SCAN (n), the second transistor T2 connects a data line 14 and the third node N3. In response to the n-th emission signal EM(n), the third transistor T3 connects the third node N3 and an input terminal of the high-potential driving voltage VDD. In response to the n-th emission signal EM(n), the fourth transistor T4 connects the second node N2 and the fourth node N4. In response to a (n−1)-th scan signal SCAN(n−1), the fifth transistor T5 connects the first node N1 and an input terminal of the initialization voltage Vinit. In response to the n-th scan signal SCAN(n), the sixth transistor T6 connects the input terminal of the initialization voltage Vinit and the fourth node N4. In addition, the storage capacitor Cst is connected between the first node N1 and the input terminal of the high-potential driving voltage VDD.

Figure 4:
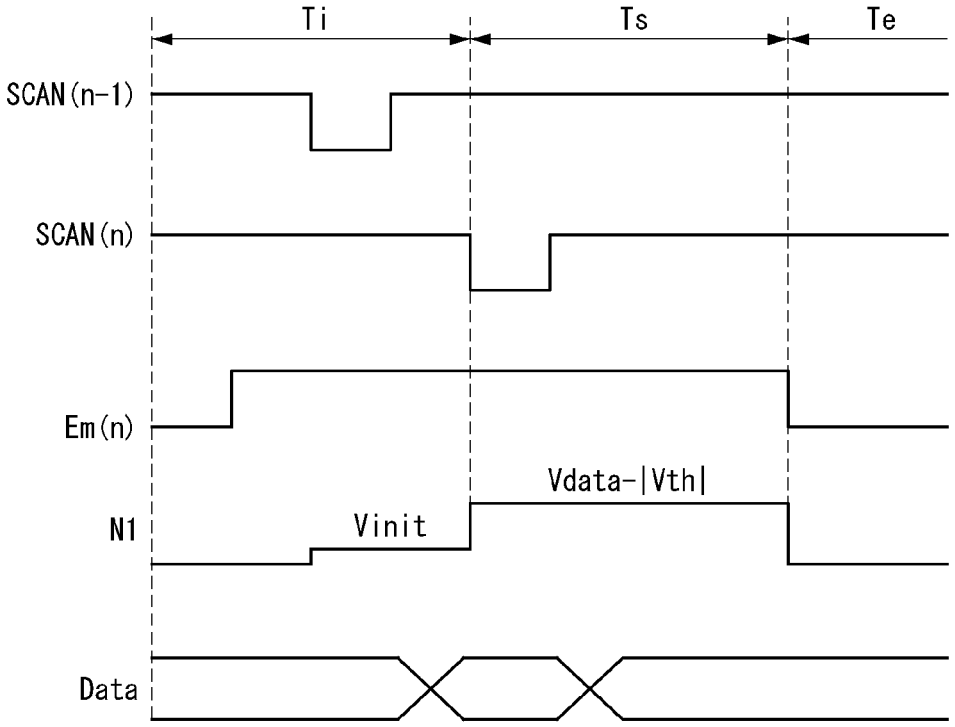
FIG. 4 is a diagram illustrating timings of gate signals for driving the pixel shown in FIG. 3.

FIG. 4 is a diagram illustrating timings of gate signals for driving the pixel shown in FIG. 3. With reference to FIGS. 3 and 4, operation of the pixel is described as below.

In an initialization period Ti, the fifth transistor T5 connects the first node N1 and the input terminal of the initialization voltage Vinit in response to the (n−1)-th scan signal SCAN(n−1). As a result, the first node N1 is initialized to the initialization voltage Vinit. The initialization voltage Vinit may be selected within a voltage range lower than an operation voltage of the OLED, and may be set equal to or lower than the low-potential driving voltage VSS.

In a sampling period Ts, the first transistor T1, the second transistor T2, and the sixth transistor T6 are turned on in response to the n-th scan signal SCAN(n). As a result, the first transistor T1 establishes diode-connection between the first node N1 and the second node N2. The second transistor T2 charges the third node N3 to a data voltage Vdata supplied through the data line DL. The sixth transistor T6 charges the fourth node N4 to the initialization voltage Vinit.

In the sampling period Ts, a current is flowing between the source electrode and the drain electrode of the driving TFT DT, and accordingly, a voltage of the second node N2 becomes Vdata(n)−|Vth| which indicates a value obtained by subtracting an absolute value of a threshold voltage Vth of the driving TFT DT from the data voltage Vdata. The first node N1 becomes to have the same voltage as that of the second node N2.

In an emission period Te, the third transistor T3 supplies the high-potential driving voltage VDD to the third node N3 in response to the n-th emission signal EM(n). The fourth transistor T4 is turned on to connect the second node N2 and the fourth node N4. In the emission period Te, a current bypassing from the third node N3 to the second node N2 is generated due to a set gate-source voltage of the driving TFT DT.

The current IOLED flowing in the OLED in the emission period Te may be represented by Equation 1, as below.

$$IOLED=k/2(Vgs-Vth)^2=k/2(Vg-Vs-Vth)^2=k/2\{(Vdata-|Vth|)-VDD-Vth)\}^2 \quad \text{Equation 1}$$

At this point, Vth<0, and thus, Equation 1 can be summarized in "k/2(Vdata−VDD)$^2$".

In Equation 1, k/2 denotes a proportionality constant which is determined by electron mobility of the driving TFT DT, a parasitic capacitance, and a channel capacity. During the emission period Te, the driving current flowing in the OLED is not affected by the threshold voltage Vth of the driving TFT DT.

To rule out any possibility of influence by the threshold voltage Vth of the driving TFT DT in operation of an internal compensation circuit during the emission period Te, the first node should be sufficiently saturated at a value of Vdata−|Vth|.

Figure 5:
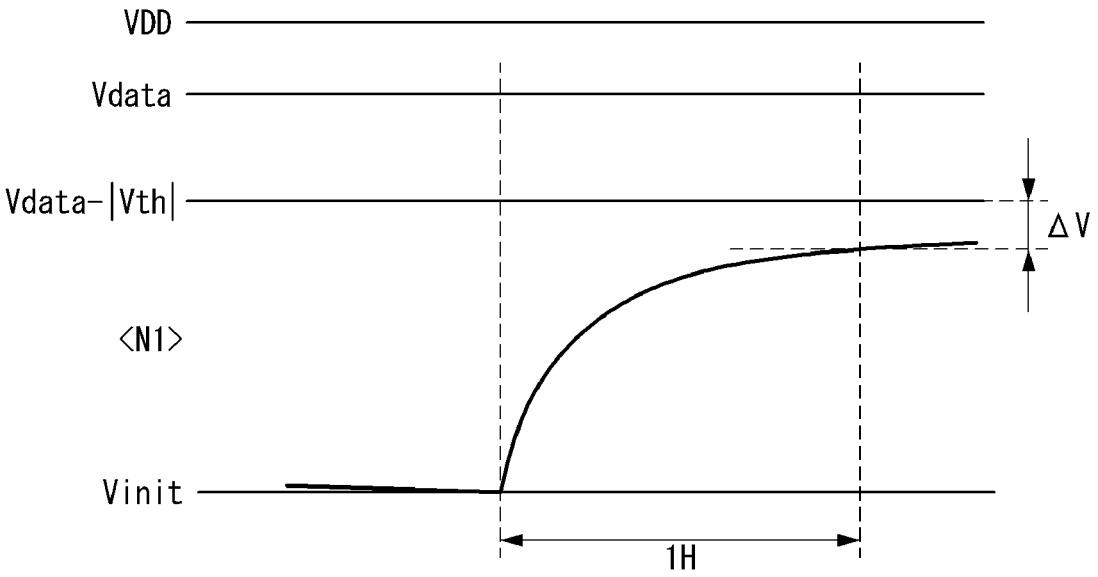
FIG. 5 is a diagram illustrating change in a voltage of a first node shown in FIG. 3.

However, as resolution of the display panel 10 increases, one horizontal period 1H for driving one pixel line is reduced and accordingly, even a sampling period Ts is reduced as well. As illustrated in FIG. 5, if the first node N1 fails to be saturated to a sufficient value during a sampling period of one horizontal period 1H, there may be a sampling deviation ΔV and this may cause an error in internal compensation.

The compensation value setting unit 100 and the data driver 12 according to the present disclosure are capable of more accurately sampling a threshold voltage of a driving TFT within a short sampling period. Description thereof is provided in the following.

The timing controller 11 sets a compensation value a which is used to generate a compensation data voltage. The compensation value a may be calculated as a value that is a ratio of a voltage Vsam charged to the first node N1 in a sampling period of one horizontal period 1H relative to a voltage value Vsat at which the first node N1 is saturated when a long enough sampling period Ts is given. That is, the compensation value a is calculated into "Vsat/Vsam". The voltage Vsam changed in the first node N1 during the first horizontal period 1H is equal to or smaller than the voltage value Vsat at which the first node N1 is saturated, and thus, the compensation value a is greater than 1. The compensation value a may be set identical or different for each gray level.

FIG. 1 illustrates an example in which the compensation value setting unit 100 is included in the timing controller 11, but the compensation value setting unit 100 may be included in an additional Integrated Circuit (IC), which may be separate from the timing controller 11.

Figure 6:
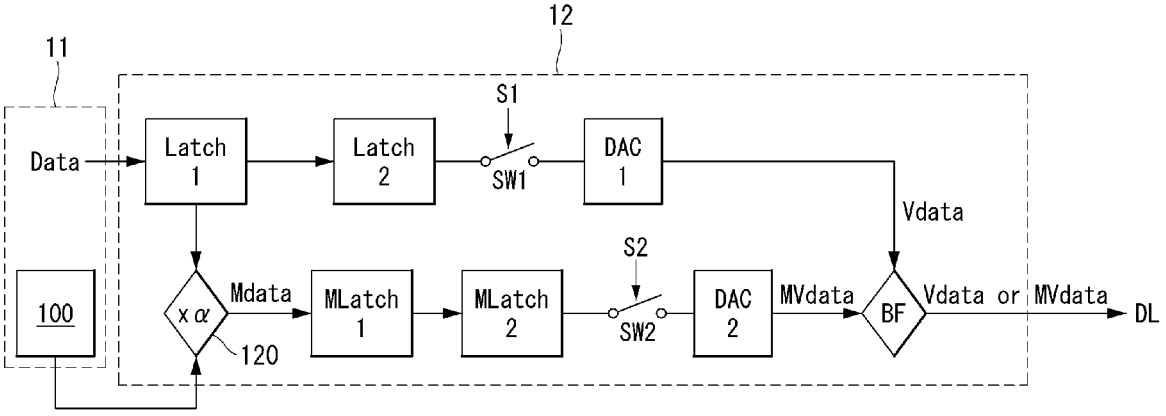
FIG. 6 is a diagram illustrating a data driver according to a first embodiment of the present disclosure.

FIG. 6 is a diagram illustrating a data driver according to a first embodiment of the present disclosure. FIG. 6 illustrates an example in which a data voltage is output to one data line.

Referring to FIG. 6, a data driver 12 according to a first embodiment includes a latch unit Latch1 and Latch 2, a first switch SW1, a first digital-to-analog converter DAC1, a compensation data generator 120, a compensation latch unit MLatch1 and MLatch 2, a second switch SW2, a second digital-to-analog converter DAC2, and an output buffer BF. The latch unit Latch1 and Latch 2 includes a first latch Latch 1 and a second latch Latch 2, and the compensation latch unit MLatch1 and MLatch2 includes a first compensation latch MLatch1 and a second compensation latch MLatch2. The first latch Latch 1 may be referred to herein as an input unit, which receives input data as will be described herein. The output buffer BF may be referred to herein as an output unit, which separately outputs the image data voltage Vdata and the compensation data voltage MVdata as will be described herein. The first digital-to-analog converter DAC1 and the second digital-to-analog converter DAC2 may collectively be referred to as a converter unit, which converts the input data into an image data voltage Vdata and converts compensation data Mdata into a compensation data voltage MVdata as will be described herein.

The first latch Latch1 samples and latches digital image data Data received from the timing controller 11, and simultaneously outputs all the latched data. The second latch Latch2 latches image data Data received from the first latch Latch1, and simultaneously output all the latched image data in sync with second latches Latch2 of other source drivers.

In response to a first control signal S1, the first switch SW1 connects the second Latch2 and the first digital-to-analog converter DAC1.

The first digital-to-analog converter DAC1 converts the image data Data received from the second latch Latch2 into an analog data voltage Vdata.

The compensation data generator 120 generates compensation data Mdata by applying a compensation value a to the data received from the first latch Latch1. The compensation data Mdata may be generated as data is multiplied by the compensation value a. The compensation data generator 120 outputs the compensation data Mdata to the first compensation latch MLatch1.

The first compensation latch MLatch1 samples and latches the compensation data Mdata received from the compensation data generator 120, and simultaneously outputs all the latched data.

The second compensation latch MLatch2 latches the compensation data Mdata received from the first compensation latch MLatch1, and simultaneously outputs all the latched compensation data in sync with second compensation latches MLatch2 of other source drivers.

In response to a second control signal S2, the second switch SW2 may connect the second compensation latch MLatch2 and the second digital-to-analog converter DAC2.

The second digital-to-analog converter DAC2 converts the compensation data Mdata received from the second compensation latch MLatch2 into an analog compensation data voltage MVdata.

An output buffer BF provides the data line DL with the data voltage Vdata from the first digital-to-analog converter DAC1 or the compensation data voltage MVdata from the second digital-to-analog converter DAC2.

Figure 7:
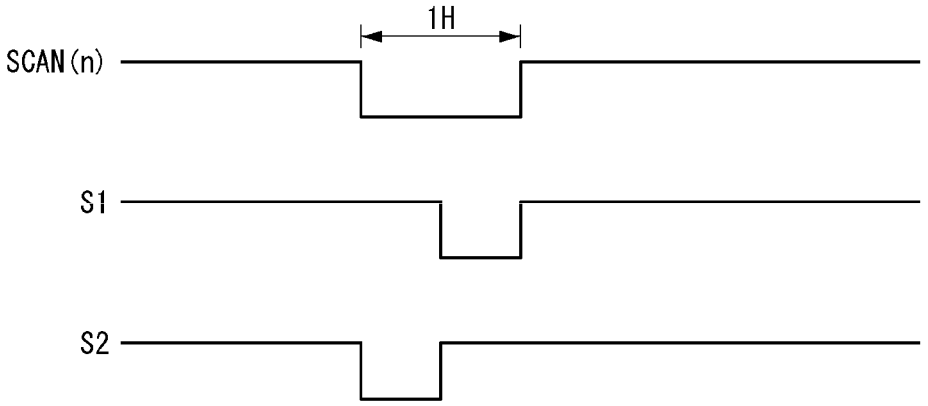
FIG. 7 is a diagram illustrating timings of first and second control signals shown in FIG. 6.
Figure 8:
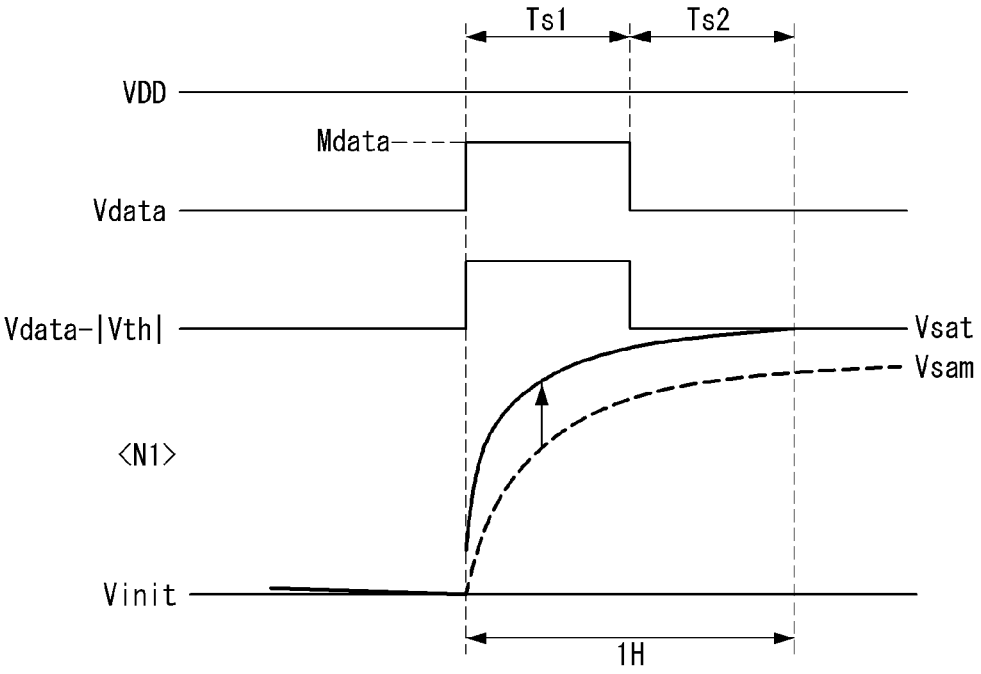
FIG. 8 is a diagram illustrating change in a voltage of the first node in an initialization period and a sampling period according to the first embodiment of the present disclosure.

FIG. 7 is a diagram illustrating timings of first and second control signals shown in FIG. 6. FIG. 8 is a diagram illustrating change in a voltage of the first node in an initialization period and a sampling period according to the first embodiment of the present disclosure. Gate signals for driving pixels in the first embodiment are the same as those in a comparable example. That is, the gate signals shown in FIG. 4 may be used to drive pixels shown in FIG. 3.

With reference to FIGS. 3, 4, 6 and 8, sampling operation by use of a compensation data voltage is described as below.

In an initialization period Ti, the fifth transistor T5 connects the first node N1 and the input terminal of the initialization voltage Vinit in response to the (n−1)-th scan signal SCAN(n−1). As a result, the first node N1 is initialized to the initialization voltage Vinit. The initialization voltage Vinit may be selected within a voltage range lower than an operation voltage of the OLED, and may be set equal to or lower than the low-potential driving voltage VSS.

In first and second sampling periods Ts1 and Ts2, the first transistor T1, the second transistor T2, and the sixth transistor T6 are turned on in response to the n-th scan signal SCAN(n). As a result, the first transistor T1 establishes diode-connection between the first node N1 and the second node N2.

During the first sampling period Ts1, the second control signal S2 becomes a turn-on voltage. As a result, the second digital-to-analog converter DAC2 receives compensation data Mdata from the second compensation latch MLatch2, and generates a compensation data voltage MVdata. During the first sampling period Ts1, the output buffer BF outputs the compensation data voltage MVdata to the data line DL.

The second transistor T2 charges the third node N3 to a data voltage Vdata supplied through the data line DL. The compensation data voltage MVdata has a value greater than the data voltage VData, and thus, the third node N3 is charged to a value greater than the data voltage Vdata during the first sampling period Ts1. As a result, due to over driving effects, the voltage of the first node N1 in the first sampling period Ts1 has a value greater than the data voltage Vdata charged to the third node N3.

During the second sampling period Ts2, the second control signal S2 becomes a turn-off voltage and the first control signal S1 becomes a turn-on voltage. As a result, the first digital-to-analog converter DAC1 receives image data from the first latch Latch1, and generates an image data voltage VData. During the second sampling period Ts2, the output unit BF outputs the image data voltage VData to the data line.

The second transistor T2 charges the third node N3 to the data voltage supplied through the data line DL. The image data voltage VData has a value smaller than the compensation data voltage MVdata, and thus, the speed of charging the first node N1 to a voltage is reduced during the second sampling period Ts2. In particular, as the image data voltage VData is a voltage corresponding to the image data Data received by the timing controller 11, the first node N1 may be accurately sampled after the second sampling period Ts2 to a voltage having a value Vdata−|Vth| which corresponds to a desired gray level.

In the emission period Te, a current bypassing from the third node N3 to the second node N2 is generated due to a set gate-source voltage of the driving TFT DT, and the OLED emits light of a desired gray level.

As described above, the data driver 12 according to the present disclosure performs a sampling operation during a first sampling period Ts1 by using a compensation data voltage MVdata to which a compensation value a is applied, and therefore, the sampling operation may be performed fast. Accordingly, although one horizontal period 1H is reduced, a gate-source voltage of the driving TFT DT may be sampled during a sampling period to the voltage Vsat having an accurate value which reflects a threshold voltage. That is, if one horizontal period 1H is reduced, the first node N1 is charged to a voltage level of Vsam during the sampling period Ts1 and Ts2, and thus, the sampling operation may be performed inaccurately. However, according to the present disclosure, due to over driving of the first sampling period Ts1, it is possible to sample a voltage of the first node N1 to a voltage Vsat having an accurate value which reflects the threshold voltage of the driving TFT DT In particular, the present disclosure is expected to have an over-driving effect without increasing a driving frequency. Thus, if sampling is performed simply by increasing a data voltage, a voltage value to be sampled may exceed a desired level. To prevent this problem, a data voltage to be applied in a sampling period needs to be controlled at a level corresponding to input image data. However, a pulse width length of a scan signal which determines a sampling period in an organic light emitting display device corresponds to one horizontal period at minimum, and thus, it is necessary to increase a driving frequency in order to perform sampling twice.

On contrary, the present disclosure is implemented such that the data driver 12 separately output, within one horizontal period 1H, an image data voltage Vdata of image data Data, and a compensation data voltage MVdata in which a compensation value a is reflected. Accordingly, it is possible to perform overdriving without increasing a driving frequency and varying a timing of a scan signal.

Figure 9:
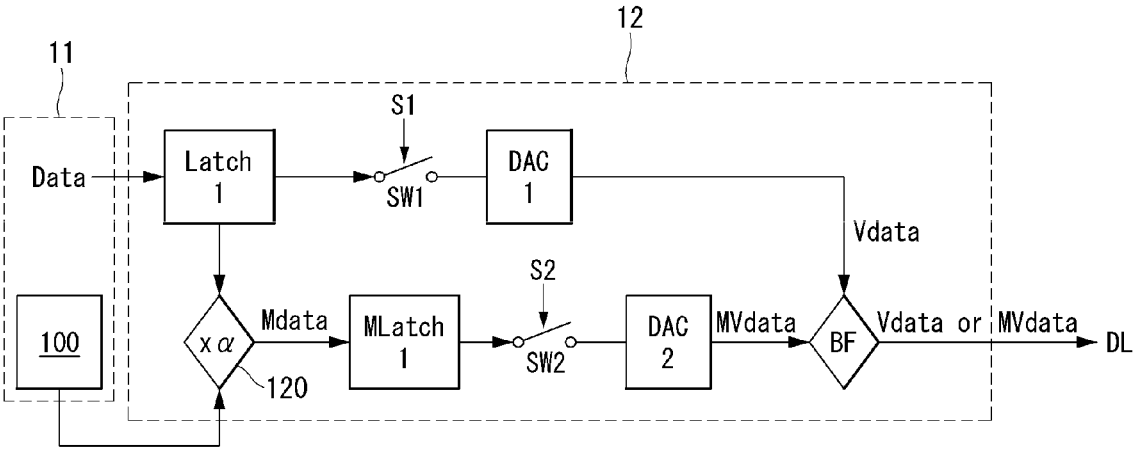
FIG. 9 is a diagram illustrating a data driver according to a second embodiment of the present disclosure.

FIG. 9 is a diagram illustrating a data driver according to a second embodiment of the present disclosure.

Referring to FIG. 9, a data driver 12 according to a second embodiment of the present disclosure includes a latch unit Latch1, a first switch SW1, a first digital-to-analog converter DAC1, a compensation data generator 120, a compensation latch unit MLatch1, a second switch SW2, a second digital-to-analog converter DAC2, and an output buffer BF. That is, in the second embodiment, each of the latch unit Latch1 and the compensation latch unit MLatch1 is implemented as a single latch. The number of latch units in the first and second embodiments may vary depending on the design of a timing controller of the data driver. In the second embodiment, operation of the compensation latch unit MLatch is the same as that described in the first embodiment, and a timing for the data driver to output a compensation data voltage is the same as that described in the first embodiment.

Figure 10:
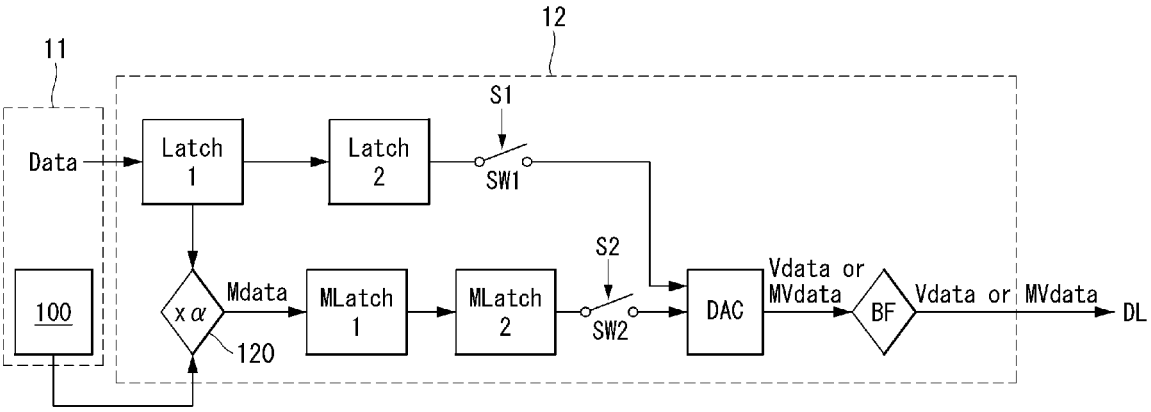
FIG. 10 is a diagram illustrating a data driver according to a third embodiment of the present disclosure.

FIG. 10 is a diagram illustrating a data driver according to a third embodiment of the present disclosure.

Referring to FIG. 10, a data driver 12 according to a third embodiment of the present disclosure includes a latch unit (Latch1, Latch2), a first switch SW1, a compensation data generator 120, a compensation latch unit (MLatch1, MLatch2), a second switch SW2, a digital-to-analog converter DAC, and an output buffer BF. The latch unit (Latch1, Latch2) includes a first latch Latch1 and a second latch Latch2, and the compensation latch unit (Latch2, Latch2) includes a first compensation latch MLatch1 and a second compensation latch MLatch2. When the first switch SW1 is turned on, the digital-to-analog converter DAC converts image data Data received from the second latch Latch2 into an analog data voltage Vdata. When the second switch SW2 is turned on, the digital-to-analog converter DAC converts input data Mdata received from the second compensation latch MLatch2 into an analog compensation data voltage MVdata.

As such, in the third embodiment, it is possible to selectively generate between an image data voltage Vdata or a compensation data voltage MVdata and output the selected voltage by using one digital-to-analog converter DAC.

Each of the latch unit and the compensation latch unit shown in FIG. 10 may be implemented as a single latch, as the same as in the second embodiment.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A data driver for an organic light emitting display, the data driver comprising:

an input latch configured to receive an input data;

a compensation data generator including:

a first input connected to an output of a timing controller and configured to receive a compensation value from the timing controller for the organic light emitting display, a second input connected to an output of the input latch and configured to receive the input data from the input latch, and an output configured to output a compensation data, the compensation data generator configured to generate the compensation data by applying the compensation value to the input data;

at least one digital-to-analog converter configured to convert the input data into an image data voltage and to convert the compensation data into a compensation data voltage; and an output buffer configured to separately output the image data voltage and the compensation data voltage to a data line of the organic light emitting display.

2. The data driver according to claim 1, wherein the output buffer is configured to separately output the image data voltage and the compensation data voltage within one horizontal period for driving one pixel line of the organic light emitting display.

3. The data driver according to claim 1, wherein the compensation data generator is configured to generate the compensation data by multiplying the input data by the compensation value.

4. The data driver according to claim 1, wherein the input data is received by the input latch from the timing controller for the organic light emitting display.

5. The data driver according to claim 1, wherein the at least one digital-to-analog converter comprises:

a first digital-to-analog converter configured to convert the input data into the image data voltage; and a second digital-to-analog converter configured to convert the compensation data into the compensation data voltage.

6. The data driver according to claim 1, wherein the at least one digital-to-analog converter comprises a single digital-to-analog converter configured to convert the input data into the image data voltage and to convert the compensation data into the compensation data voltage.

7. The data driver according to claim 1, wherein the input latch is configured to latch the input data and provide the input data to the compensation data generator.

8. The data driver according to claim 1, wherein the input latch is configured to latch the input data, and the data driver further includes at least one compensation latch for latching the compensation data.

9. A data driver for an organic light emitting display, the data driver comprising:

an input latch configured to receive an input data and to latch the input data;

a compensation data generator configured to generate a compensation data by applying a compensation value to the input data;

at least one digital-to-analog converter configured to convert the input data into an image data voltage and to convert the compensation data into a compensation data voltage;

at least one compensation latch configured to latch the compensation data;

an output buffer configured to separately output the image data voltage and the compensation data voltage to a data line of the organic light emitting display;

a first switch configured to connect the input latch and the at least one digital-to-analog converter in response to a first control signal; and a second switch configured to connect the at least one compensation latch and the at least one digital-to-analog converter in response to a second control signal.

10. The data driver according to claim 9, wherein the at least one digital-to-analog converter includes:

a first digital-to-analog converter coupled between the first switch and the output buffer; and a second digital-to-analog converter coupled between the second switch and the output buffer.

11. An organic light emitting display device, comprising:

a timing controller; and a data driver, including:

an input latch configured to receive an input data;

a compensation data generator including:

a first input connected to an output of the timing controller and configured to receive a compensation value from the timing controller of the organic light emitting display device, a second input connected to an output of the input latch and configured to receive the input data from the input latch, and an output configured to output a compensation data, the compensation data generator configured to generate the compensation data by applying the compensation value to the input data;

at least one digital-to-analog converter configured to convert the input data into an image data voltage and to convert the compensation data into a compensation data voltage; and an output buffer configured to separately output the image data voltage and the compensation data voltage to a data line of the organic light emitting display.

12. The organic light emitting display device according to claim 11, wherein the output buffer is configured to separately output the image data voltage and the compensation data voltage within one horizontal period for driving one pixel line of the organic light emitting display.

13. The organic light emitting display device according to claim 11, wherein the compensation data generator is configured to generate the compensation data by multiplying the input data by the compensation value.

14. The organic light emitting display device according to claim 11, wherein the input data is received by the input latch from the timing controller of the organic light emitting display.

15. The organic light emitting display device according to claim 11, wherein the at least one digital-to-analog converter comprises:

a first digital-to-analog converter configured to convert the input data into the image data voltage; and a second digital-to-analog converter configured to convert the compensation data into the compensation data voltage.

16. The organic light emitting display device according to claim 11, wherein the at least one digital-to-analog converter comprises a single digital-to-analog converter configured to convert the input data into the image data voltage and to convert the compensation data into the compensation data voltage.

17. The organic light emitting display device according to claim 11, wherein the input latch is configured to latch the input data and provide the input data to the compensation data generator.

18. The organic light emitting display device according to claim 11, wherein the input latch is configured to latch the input data, and the data driver further includes at least one compensation latch for latching the compensation data.

19. The organic light emitting display device according to claim 18, wherein the data driver further includes:

a first switch configured to connect the one input latch and the at least one digital-to-analog converter in response to a first control signal; and a second switch configured to connect the at least one compensation latch and the at least one digital-to-analog converter in response to a second control signal.

20. The organic light emitting display device according to claim 19, wherein the at least one digital-to-analog converter comprises a single digital-to-analog converter coupled between the output buffer and each of the first and second switches.

* * * * *